United States Patent [19]

Perner et al.

[11] 4,207,199

[45] Jun. 10, 1980

[54] SOLID COLD BLEACH ACTIVATORS FOR DETERGENTS AND CLEANING AGENTS CONTAINING AN ACTIVE OXYGEN DONOR

[75] Inventors: Johannes Perner, Neustadt; Herbert Helfert, Frankenthal, Fed. Rep. of Germany

[73] Assignee: BASF Aktiengesellschaft, Fed. Rep. of Germany

[21] Appl. No.: 927,045

[22] Filed: Jul. 24, 1978

[30] Foreign Application Priority Data

Jul. 27, 1977 [DE] Fed. Rep. of Germany ..... 2733849

[51] Int. Cl.[2] ..... C11D 10/00

[52] U.S. Cl. ..... 252/174.13; 252/95; 252/99; 252/186; 427/220; 428/402; 428/404

[58] Field of Search ..... 252/99, 95, 186, 89; 427/220; 428/404, 402

[56] References Cited

U.S. PATENT DOCUMENTS

| | | | |
|---|---|---|---|
| 3,163,606 | 12/1964 | Viveen et al. | 252/99 X |
| 3,532,634 | 10/1970 | Woods | 252/95 |
| 3,583,924 | 6/1971 | Demangeon | 252/99 X |
| 3,687,803 | 8/1972 | Grayson | 252/99 UX |
| 4,087,383 | 5/1978 | Gernand et al. | 427/220 X |

*Primary Examiner*—Mayer Weinblatt

*Attorney, Agent, or Firm*—Keil & Witherspoon

[57] ABSTRACT

Solid cold bleach activator formulations for detergents which contain, as the active ingredient, a compound carrying acyl groups adsorbed on a three-dimensionally crosslinked water-insoluble inorganic compound having silicon-oxygen and/or aluminum-oxygen bonds.

3 Claims, No Drawings

SOLID COLD BLEACH ACTIVATORS FOR DETERGENTS AND CLEANING AGENTS CONTAINING AN ACTIVE OXYGEN DONOR

The present invention related to novel, stable and easily prepared cold bleach activators for detergents and cleaning agents, which contain an active oxygen donor as the bleaching agent. It is known that active oxygen donors, eg. sodium perborate, only decompose at above 70° C. at the speed required for a washing process.

It is for this reason that activators are employed which accelerate the process, ie. permit the process to take place even in delicate fabric washing cycles which are run at from about 30° to 70° C. Hence these activators are referred to, albeit not entirely accurately, as cold bleach activators.

The activators are organic compounds which, in alkaline solution, form organic per-compounds with the inorganic per-compounds; these organic per-compounds in turn decompose like the inorganic per-compounds, but do so even at room temperature. It has long been known that percarboxylic acids exhibit this property. For this reason acyl compounds which interact with, for example, perborates to form percarboxylic acids, have been chosen as such activators.

A large number of acyl compounds for this purpose have already been disclosed; they are in the main N-acyl and O-acyl compounds but also include acid halides, anhydrides, esters and the like. The compounds which have been tried are liquid or solid at room temperature; good results have been achieved with both types. Since detergents are in the main marketed as solids, it is only solid activators which have hitherto been of practical importance.

An additional aspect is that acyl compounds are chemically less stable (due to hydrolysis) when they come into contact with alkalis contained in detergents, so that it has only been possible to use acyl compounds where these have been provided with a protective coating.

For example, it has been possible to protect solid acyl derivatives from hydrolysis by providing them with a coating, but this is not immediately possible with liquid acyl derivatives.

German Published Application DAS 1,162,967 discloses, for example, the use of N-acyl and O-acyl compounds in granular form, which, to achieve better stabilization of their activity, are additionally coated with a water-soluble compound, eg. a polyethylene glycol. Similar teachings are to be found in German Laid-open Applications DOS 2,360,340, 1,444,001, 2,220,296 and 2,048,331; in some cases (German Laid-Open Application DOS 2,138,584) it is preferred tha the activators should only melt above 70° C.

Pure acyl derivatives can more easily be prepared industrially if they are liquid, since in that case simple distillation processes can replace the crystallization processes which are required to purify solid compounds and which are often involved.

It is an object of the present invention to make it possible to use liquid activators in solid detergents and cleaning agents.

We have found that this object is achieved, surprisingly, by adsorbing the liquid acyl compounds on conventional inorganic adsorbents.

The invention relates to a solid cold bleach activator formulation which contains, as the active ingredient, a compound carrying acyl groups, for a detergent to which an active oxygen donor is admixed as a bleaching agent, which formulation consists of an adsorbate of a liquid compound, containing acyl groups, on a three-dimensionally crosslinked macromolecular water-insoluble inorganic compound whose structure is characterized by silicon-oxygen bonds, the silicon being in an oxidation state of +4, and/or aluminum-oxygen bonds.

For the purposes of the invention, liquid compounds containing acyl groups, hereinafter simply referred to as acyl compounds, are compounds which are liquid under the conditions of a delicate fabric wash, preferably even at room temperature, and which are derived from lower aliphatic or aromatic carboxylic acids and contain —N—CO—, —O—CO or halogen—CO—groups. Examples are N-acyl and O-acyl compounds and acid chlorides, eg. diacetylmethylamine, diacetylbutylamine, triacetylethanolamine, benzoyl chloride and acetic anhydride. Further examples are diacetylethylamine, diacetylpropylamine, diacetylisopropylamine, diacetylisobutylamine, acetyl-propionyl-methylamine, di-propionylmethylamine, acetyl-benzoyl-methylamine, triacetyl-isopropanolamine, triacetylethanolamine, propionic anhydride, butyric anhydride, isobutyric anhydride, N-acetyl pyrrolidone and N-acetyl-caprolactam.

Three-dimensionally crosslinked macromolecular water-insoluble inorganic compounds for the purposes of the invention are those which contain silicon-oxygen bonds, the silicon being in an oxidation state of +4, and/or aluminum-oxygen bonds. Accordingly, they comprise activated silica, $SiO_2$ and especially salts of silicic acid, mixed aluminum-silicon-oxygen compounds and aluminum oxide, all of which contain a three-dimensional lattice capable of adsorbing liquids.

The inorganic compounds may be amorphous or crystalline but must have a sufficiently large surface area to be a sufficiently effective adsorbent.

Examples of such compounds are aluminum silicates, sodium aluminum silicates, calcium aluminum silicates and magnesium aluminum silicates, for example zeolites, eg. X-zeolites and A-zeolites, bentonites, eg. montmorillonite, kieselguhr and activated silicas. Aluminum oxide (in most cases in the form of a powder) can also be used.

These compounds, hereinafter referred to as adsorbents, are able to adsorb up to 80% by weight, based on the adsorbent, of the acyl compounds. Usually they contain from 30 to 60% by weight of the acyl compounds. Adsorption is simple and is carried out by, for example, stirring a zeolite in powder form into the acyl compound, in the selected ratios. Dry powders, which can be handled in the conventional manner, are obtained. It is self-evident that the adsorbents selected should be substantially anhydrous to avoid hydrolytic decomposition of the acyl compounds. Surprisingly, it has beend found that these liquid activator additives in the presence of the adsorbents show hardly any loss in activity even after prolonged storage, this being true even at elevated temperatures. Further, we have found that the bleaching action of the new formulations is in no way inferior to the conventional solid acyl derivatives.

The present invention thus makes it possible to employ liquid acyl compounds which are substantially simpler to purify and thus result in a substantial cost saving.

The Examples which follow illustrate the invention: The following compounds were tested:

| | |
|---|---|
| diacetylmethylamine<br>diacetylbutylamine | according to the invention |
| tetraacetylglycoluril | according to German Laid-Open Application DOS 2,048,331. |

The two liquid acyl compounds were adsorbed on X-zeolites, A-zeolites, silica gel, kieselguhr, silica aerogel and aluminum oxide, in an activator: adsorbent ratio ranging from 4:1 (for silica aerogel) to 1:4 (for A-zeolite). They were also tested in the non-adsorbed state.

The solid activator tetraacetylglycoluril was employed directly.

1.Determination of the activation values

An activation value, the method of determination of which is described in principle in German Laid-Open Application DOS 2,138,584, was selected as a measure of the activating effect, ie. of the liberation of bleaching peracid. The method comprises mixing the active oxygen donor with defined amounts of the activator, dissolving the mixture, heating the solution, adding potassium iodide and starch and immediately titrating with thiosulfate.

Specifically, the following procedure was used:

Solutions containing 0.615 g/l of $NaBO_2.H_2O_2:3H_2O$ (4 millimoles/1) and 2.5 g/l of $Na_4P_2O_7.10\ H_2O$ were heated to 60° C., 4 millimoles/1 of activator were added, and the mixture was kept at 60° C. for 5 minutes, whilst stirring. 100 ml of this liquid were then added to a mixture of 250 g of ice and 15 ml of glacial acetic acid, and immediately after adding 0.35 g of potassium iodide the mixture was titrated with 0.1 N sodium thiosulfate solution, using starch as the indicator; the amount of thiosulfate consumed, in ml, is the activation value. For 100% activation of the peroxide, the activation value would be 8.0 ml.

The values in Table 1 are based on 1 g of activator.

Table 1

Activation value of liquid cold bleach activators (without added alkali)

| Cold bleach activator | Adsorbent | Activation value/g of cold bleach activator: immediate | after 14 days at 50° C. | after 42 days at 50° C. | after 42 days at room temperature | Weight ratio of activator: adsorbent |
|---|---|---|---|---|---|---|
| DAMA | — | 10.8 | 10.8 | 9.4 | 10.8 | — |
| DABA | — | 8.2 | 8.2 | 8.0 | 8.2 | — |
| DAMA | X-zeolite | 10.7 | 10.7 | 9.3 | 10.7 | 1:1 |
| DAMA | A-zeolite | 10.7 | 10.7 | 9.4 | 10.7 | 2:3 |
| DABA | X-zeolite | 7.2 | 7.2 | 6.8 | 7.2 | 1:1 |
| DABA | A-zeolite | 7.5 | 7.2 | 7.0 | 7.4 | 2:3 |
| DAMA | kieselguhr | 10.1 | 9.9 | 9.8 | 10.0 | 1:1 |
| DAMA | silica gel | 10.2 | 10.0 | 9.6 | 10.1 | 1:1 |
| DAMA | silica aerogel | 10.2 | 10.0 | 10.4 | 10.2 | 4:1 |
| DAMA | $Al_2O_3$ | 9.5 | 9.2 | 9.0 | 9.3 | 1:4 |

DAMA = diacetyl-methylamine
DABA = diacetyl-butylamine

The results show that the adsorption of diacetylmethylamine and diacetylbutylamine on the zeolites results in hardly any loss of activity compared to the non-adsorbed compounds.

2. Determination of the bleaching action in detergents

The practical usefulness was determined by washing and bleaching experiments on gray cotton cloth and on artificially soiled cotton fabric. Suitable artificial bleachable soiling has proved to be the soiling produced by tea or red wine on cotton fabric. The results of such bleaching experiments which simulate practical conditions are described in Table 2. The bleaching experiments were carried out at room temperature, at 25°-45° C., at 35°-60° C. and at 40°-95° C. The experimental conditions were as follows:

washing machine: Launder-Ometer
water hardness: 16° German hardness
amount of fabric: 20 g
amount of liquor: 250 ml
liquor ratio: 12.5:1
detergent concentration: 7 g/l
Detergent composition:
- 10% of alkylbenzenesulfonate
- 40% of pentasodium triphosphate
- 20% of sodium perborate tetrahydrate
- 10% of sodium sulfate
- 4% of magnesium silicate
- 10% of cold bleach activator (based on active substance; the proportion of adsorbent was deducted from the pentasodium triphosphate constituent)

remainder $H_2O$

The test fabrics were as follows:

1. 2×10 g gray cotton cloth
2. 5 g of cotton fabric soiled with tea +15 g of untreated cotton fabric
3. 5 g of cotton fabric soiled with red wine +15 g of untreated cotton fabric The bleaching action was determined by measuring the whiteness on an Elrepho photometer. The initial values of the test fabrics, namely of the gray cotton cloth, cotton fabric soiled with tea and cotton fabric soiled with red wine, were respectively taken a 100%. A detergent containing sodium sulfate instead of the cold bleach activator served as the control. The difference between the values without a cold bleach activator and the initial value of 100% can be regarded as the proportion of soiling which can be washed out. However, this does not apply to the washing test at 95° C., at which temperature the sodium perborate by itself has a bleaching action. Table 2 shows clearly that the liquid cold bleach activators taken up by the sorbents give good bleaching results. A comparison with solid activators (eg. tetraacetylglycoluril) shows only insignificant differences.

Table 2

Bleaching action of liquid cold bleach activators

| Cold bleach activator | Bleaching action in % | | | | | | | | | | | |
|---|---|---|---|---|---|---|---|---|---|---|---|---|
| | 30 minutes at room temperature | | | 30 minutes at 25°-45° C. | | | 30 minutes at 35°-60° C. | | | 45 minutes at 40°-95° C. | | |
| | gray cotton cloth | tea | red wine | gray cotton cloth | tea | red wine | gray cotton cloth | tea | red wine | gray cotton cloth | tea | red wine |
| without activator | 101.9 | 125.6 | 105.7 | 103.7 | 135.1 | 112.2 | 107.3 | 144.3 | 110.5 | 116.0 | 157.0 | 129.7 |
| DAMA | 107.3 | 135.6 | 114.1 | 113.9 | 147.9 | 123.3 | 117.6 | 153.1 | 127.6 | 123.0 | 157.3 | 130.0 |
| DABA | 105.1 | 132.6 | 113.3 | 110.5 | 144.9 | 121.2 | 115.0 | 151.6 | 123.4 | 120.6 | 157.0 | 129.8 |
| DAMA/X-zeolite (ratio 1:1 by weight) | 106.6 | 132.5 | 115.0 | 113.4 | 147.3 | 122.9 | 116.9 | 151.2 | 123.5 | 120.2 | 155.3 | 128.3 |
| DABA/X-zeolite (ratio 1:1 by weight) | 104.5 | 130.6 | 112.5 | 110.1 | 143.6 | 120.3 | 113.6 | 151.2 | 125.1 | 118.6 | 155.7 | 128.3 |
| DABA/A-zeolite (ratio 2:3 by weight) | 105.7 | 128.5 | 115.0 | 111.1 | 145.5 | 122.7 | 114.8 | 151.8 | 126.2 | 119.0 | 156.6 | 129.4 |
| tetraacetylglycoluril | 106.8 | 132.6 | 113.3 | 113.9 | 146.2 | 123.8 | 118.8 | 152.5 | 126.4 | 122.5 | 157.7 | 129.7 |

We claim:

1. A solid cold bleach activator formulation for a detergent to which an inorganic per-compound is admixed as a bleaching agent, which formulation consisting essentially of:

(a) a liquid compound containing acyl groups, said compound being selected from the group consisting of diacetylmethylamine, diacetylbutylamine, triacetylethanolamine, benzoyl chloride, acetic anhydride, diacetylethylamine, diacetylpropylamine, diacetylisopropylamine, diacetylisobutylamine, acetyl-propionyl-methylamine, di-propionyl-methylamine, acetyl-benzoyl-methylamine, triacetyl-iso-propanolamine, triacethylethanolamine, propionic anhydride, butyric anhydride, isobutyric anhydride, N-acetylpyrrolidone, N-acetylcaprolactam and mixtures thereof, said compound (a) being absorbed on (b) a three-dimensionally crosslinked macro-molecular water-insoluble inorganic compound whose structure is characterized by silicon-oxygen bonds, the silicon being in an oxidation state of +4, aluminum-oxygen bonds or both types of bonds, said inorganic compound being selected from the group consisting of kiesel-guhr, a magnesium aluminum silicate, sodium aluminum silicate or calcium aluminum silicate, an activated silica, a silica aerogel and an aluminum oxide.

2. The cold bleach activator formulation of claim 1, in which the compound containing acyl groups is absorbed to the extent of up to 80% by weight by the inorganic compound.

3. The cold bleach activator formulation of claim 1, in which the compound containing acyl groups is absorbed is a percentage of from 30 to 60% by weight of the inorganic compound.

* * * * *